US007611148B2

(12) United States Patent
Caswell

(10) Patent No.: US 7,611,148 B2
(45) Date of Patent: Nov. 3, 2009

(54) INFLATABLE SPORTS GOAL

(75) Inventor: Tommy Caswell, Fetcham (GB)

(73) Assignee: Ready Set Goal Ltd, Farnham (GB)

( * ) Notice: Subject to any disclaimer, the term of this patent is extended or adjusted under 35 U.S.C. 154(b) by 0 days.

(21) Appl. No.: 11/813,911

(22) PCT Filed: Jan. 23, 2006

(86) PCT No.: PCT/GB2006/000215

§ 371 (c)(1),
(2), (4) Date: Jul. 13, 2007

(87) PCT Pub. No.: WO2006/077431

PCT Pub. Date: Jul. 27, 2006

(65) Prior Publication Data

US 2009/0163304 A9 Jun. 25, 2009

(30) Foreign Application Priority Data

Jan. 24, 2005 (GB) ..... 0501474.1

(51) Int. Cl.
*A63B 63/00* (2006.01)

(52) U.S. Cl. ..... 273/400; 473/478

(58) Field of Classification Search ..... 273/398–402; 473/476–478

See application file for complete search history.

(56) References Cited

U.S. PATENT DOCUMENTS

| | | | | |
|---|---|---|---|---|
| 3,137,307 A | | 6/1964 | Scurlock | |
| 3,156,471 A | * | 11/1964 | Bibeau | 473/164 |
| 4,876,829 A | | 10/1989 | Mattick | |
| 5,205,086 A | | 4/1993 | Heim | |
| 5,865,693 A | | 2/1999 | Johnson | |
| 6,179,367 B1 | * | 1/2001 | Bowen | 296/161 |
| 6,629,899 B2 | * | 10/2003 | Chauvet et al. | 473/472 |
| 7,118,487 B2 | * | 10/2006 | Turcot | 473/197 |
| 2004/0127309 A1 | * | 7/2004 | Huang | 473/476 |

FOREIGN PATENT DOCUMENTS

| | | | |
|---|---|---|---|
| DE | 2335693 A1 | | 1/1975 |
| DE | 20318473 U1 | | 12/2004 |
| GB | 2172509 A | * | 9/1986 |
| GB | 2313322 A | | 11/1997 |
| WO | 9919031 A | | 4/1999 |

* cited by examiner

*Primary Examiner*—Mark S Graham
(74) *Attorney, Agent, or Firm*—Christensen O'Connor Johnson Kindness PLLC

(57) ABSTRACT

A sports goal comprises a plurality of struts interconnected to form nodes, with netting optionally attached thereto. The struts comprise: one or more struts defining a crossbar; two or more struts defining respective goal posts; a plurality of ground struts adapted to lie along the ground to define the bottoms of respective left and right sides and a rear of the goal; bracing struts interconnecting ground struts with the nodes at which crossbar struts and goal post struts are connected to form a corner of the goal; and struts defining one or more bracing structures interconnecting ground struts defining the rear of the goal with the crossbar at one or more points intermediate the length of the crossbar. The struts are formed of a tubular material adapted to be pneumatically filled from a pneumatic pump via one or more valves provided in the struts or in means connecting respective struts at the nodes.

13 Claims, 7 Drawing Sheets

INFLATABLE SPORTS GOAL

BACKGROUND

This invention relates to goals for playing sports, for example, but not excluded to, Association Football (Soccer).

The Football Association in England and corresponding Associations in other countries and Internationally set standards for the size of goals. In addition to the full size standard which is used for League, Cup and International fixtures, there are several standards for fixtures involving youths of different ages.

For playing Soccer, a goal typically comprises a pair of spaced goal posts and a crossbar linking the tops of the goal posts, together with netting defining the back of the goal. Even if the netting is removed after a game, the goal posts and crossbar may be left in place as a permanent or semi-permanent fixture in football stadia, recreation grounds, etc. Sometimes the tops of the goal posts are formed with spikes and the ends of the crossbar are formed with corresponding holes so that the crossbar may be fitted onto the top of the goal posts enabling a semi-permanent structure to be demounted either between games or at the end of the season. Particularly in the case of amateur sides the need to store the solid structure of goal posts and crossbar, whether provided as a single unitary structure or demountable into three elements, as well as the netting, presents a major problem. In the case of Saturday afternoon fixtures on a recreation ground by an amateur team there may be no sports pavilion or storage shed locally in which these elements may be stored until they are required again. The elements of a conventional goal cannot conveniently be carried by car (automobile) from a remote storage to the ground at which a game is to be played.

The permanent or semi-permanent structure comprising the goal posts and crossbar is also unyielding; and players commonly injure themselves, particularly their heads, by contact with these structures in the course of the game. Indeed in Rugby Football it is quite common, particularly in amateur games, for the upright goal posts to be padded to prevent injury, but this is not possible in a game of Association Football (Soccer).

The present invention seeks to overcome these problems.

As explained in more detail below, it achieves this end by providing a sports goal in a fully demountable form in which the crossbar and goal posts are formed of tubular material which is pneumatically fillable on site. The present inventor has found that in order to achieve a satisfactory structure that meets the Rules of the appropriate Associations, it is necessary for the crossbar to be provided with at least one bracing support intermediate its ends and typically in a central portion thereof Without such additional bracing in such locations, the centre of the crossbar tends to sag, and the resultant goal does not meet the standards specified by the Rules of the respective Associations.

SUMMARY OF THE INVENTION

In accordance with a first aspect of the present invention, there is provided a sports goal, comprising: a structure comprising a plurality of struts interconnected to form nodes; the struts comprising: one or more struts defining a crossbar, two or more struts defining respective goal posts, a plurality of ground struts adapted to lie along the ground to define the bottoms of respective left and right sides and a rear of the goal, bracing struts interconnecting ground struts with the nodes at which crossbar struts and goal post struts are connected to form a corner of the goal, and struts defining one or more bracing structures interconnecting ground struts defining the rear of the goal with the crossbar at one or more points intermediate the length of the crossbar; the struts being formed of a tubular material adapted to be pneumatically filled from a pneumatic pump; one or more valves provided in the structure to enable the struts to be so filled from said pump; and (optionally) netting attached to said structure.

The tubular material may be formed of natural or synthetic rubber, or plastics substitutes, and is preferably reinforced with nylon thread. Netting is employed for goals to be used for sports in which the applicable Rules or Regulations require or allow netting. The netting may be attachable to the struts via hooks or eyes integrally moulded with the tubular material.

The struts may be permanently connected to each other at the nodes. Individual hollow connectors of appropriate configuration and formed with short lengths of tubing (stub pipes) may be moulded as a single piece from a hard plastics material such as nylon, with the ends of the strut tubing forced over the ends of the stub pipe and glued or welded in place. Alternatively they may be held in place with wire or suitable clips such as Jubilee clips, Alternatively, individual hollow connectors may be formed of the same or a similar material to the struts, but preferably of slightly greater thickness or with additional reinforcement to give greater rigidity; and the struts are connected to the connectors by wire or clips, or—more preferably—by a suitable adhesive or by melding, so as to produce an integral structure. The resultant structure, however connected together, may be erected on site as required, and subsequently deflated. Because the deflated structure is flexible, it may typically be rolled up and stored in the boot (trunk) of a car (automobile) or in a store room.

Additional eyes or hooks may be provided on the connectors and/or the struts for attachment of guy lines or anchors to prevent the goal moving in high winds. The goal posts and/or crossbar may be reinforced with elongate curved plastics shells shaped to conform generally to the outer surface of the pneumatically filled struts and fastened thereabout, suitably by a plurality of hook-and-loop fastener strips.

As an alternative to an integral structure, the sports goal may be readily provided as a kit of parts readily storable in the boot (trunk) of a car (automobile) for transport to the recreation ground at which a game is to be played for assembly on site into a demountable sports goal.

Accordingly, in a second and alternative aspect of the present invention, there is provided a kit of parts for assembly into a demountable sports goal, the kit comprising a plurality of lengths of tubular material adapted to form struts and a plurality of connectors adapted to form nodes interconnecting struts to form a unitary structure comprising a crossbar, goal posts, ground struts defining the bottoms of respective left and right sides and a rear of a goal, and bracing structures interconnecting the ground struts with corners of the goal defined between goalposts and ends of the crossbar and with one or more positions along the length of the crossbar intermediate its ends, the tubular material being capable of being pneumatically filled from a source of pneumatic pressure through one or more valves provided in the tubular material or in the connectors.

BRIEF DESCRIPTION OF THE DRAWINGS

The invention is hereinafter more particularly described by way of example only with reference to the accompanying drawings, in which.

DESCRIPTION OF PREFERRED EMBODIMENTS

Figure 1:
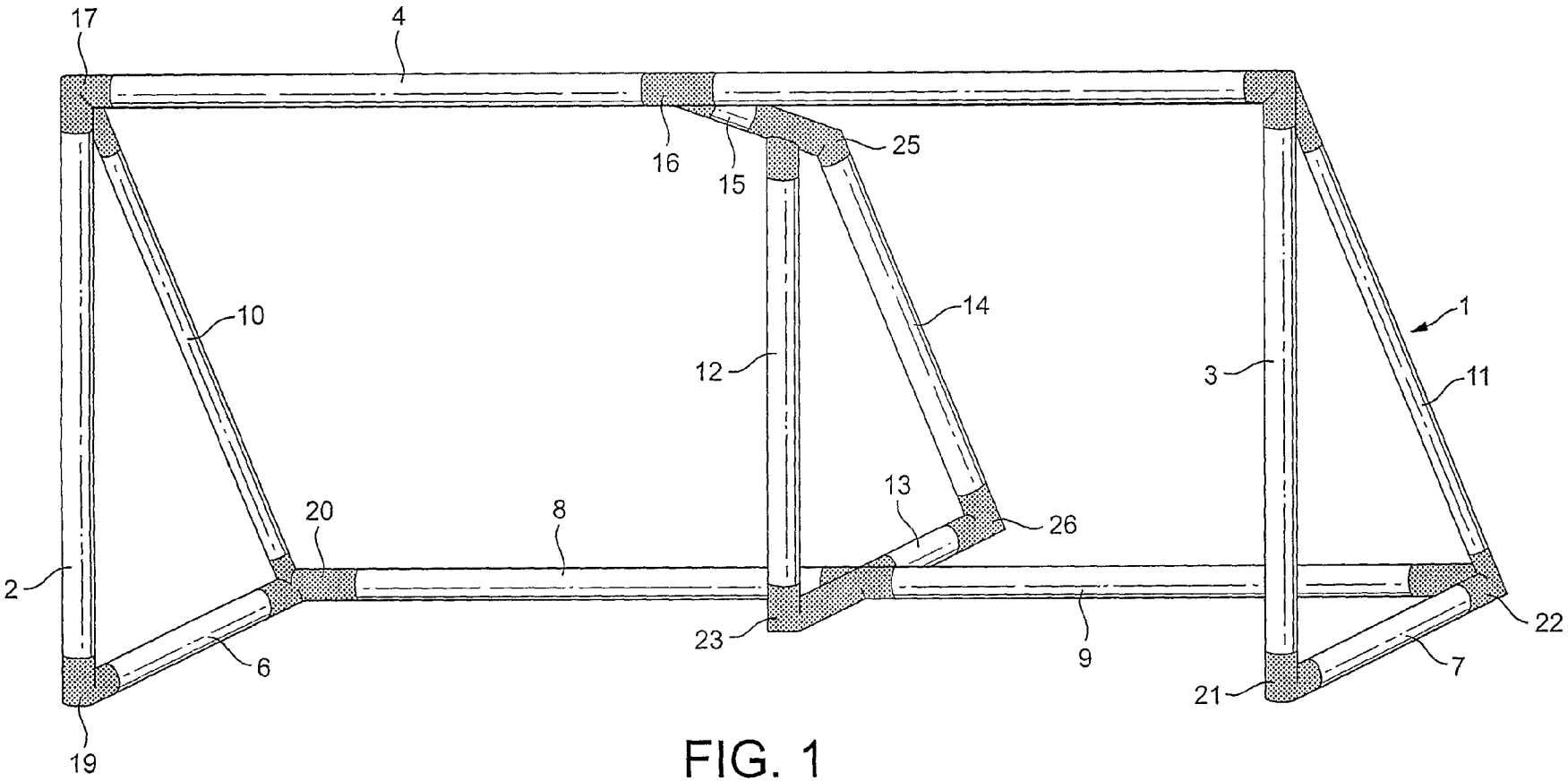
FIG. 1 is a somewhat schematic over-all perspective view of a typical sports goal constructed in accordance with the present invention.

FIG. 1 shows a typical configuration for a sports goal suitable for the standard 12 ft.×6 ft. (3.6576 m.×1.8288 m.) goal set as a standard size for the playing of youth soccer, and constructed in accordance with the teachings of the present invention. The goal 1 comprises a plurality of struts 2 to 15 and a plurality of connectors 16 to 25 forming nodes between the struts. Each strut is formed of tubular material capable of being filled pneumatically. Preferably the material from which the struts are formed expands slightly so that the struts are effectively slightly inflated rather than being merely just filled.

The struts and connectors are connected to provide goal posts 2, 3 and a crossbar formed here of two struts 4 and 5 joined at a node 16 centrally of the top of the goal. The crossbar and goal posts are connected together by connectors 17 and 18 at the top comers of the goal. The set of struts also includes ground struts 6, 7, and 8 and 9, which respectively define left and right sides of the goal and the rear of the goal. Left ground strut 6 is coupled to left goal post 2 at node 19 and to rear ground strut 8 at a rear corner node 20. Similarly right ground strut 7 is coupled at 21 to right goal post 3 and at rear corner node 22 to rear strut 9, the two struts 8 and 9 which form the rear of the goal being coupled at centre bottom node 23.

Bracing structure is also included to maintain the goal upright. The bracing structure includes bracing struts 10 and 11, which respectively interconnect rear corner node 20 and top left node 17 and rear corner node 22 and top right node 18.

The illustrated structure also incorporates a central bracing structure coupled to centre bottom node 23 and crossbar centre node 16. In this case, the bracing structure comprises struts 12, 13 and 14 which effectively define a triangle with nodes at 23, 24 and 25, strut 12 being generally upright but not necessarily vertical while strut 13 is arranged to lie along the ground. Upper node 25 of this bracing structure buttresses the centre node 16 of the crossbar via a short strut 15. other configurations for central bracing structures are feasible.

The struts 2 to 15 are suitably formed of a tubular material which may typically be of rubber, synthetic rubber or of a plastics substitute, suitably reinforced with nylon thread and which is capable of being filled pneumatically and preferably inflated slightly at the prevailing pressures employed. The thickness of the material is chosen to achieve an acceptable rigidity in the inflated structure. The present Inventor has found that material with a thickness of around 2 mm gives acceptable results with goal posts and crossbar of 3 inch (7.62 cm) diameter. The inflation pressure can vary widely. Using nylon reinforced rubber with a 2 mm thickness, inflation pressures in the range of 1 to 50 psi ($6.89*10^3$ to $3.45*10^4$ Pascals) can be used, but good results are obtained with an inflation pressure of around 20 psi ($1.38*10^4$ Pascals). Such pressures can be readily obtained by a foot-pump or a portable electrical pump of the kind for inflating car tyres (automobile tires).

The connectors forming the nodes 16 to 25 may suitably be moulded from a hard plastics material such as nylon or from a similar material to that of the struts. But preferably slightly thicker to give the connectors a degree of rigidity.

It will be seen that each node effectively defines a number of tubular stubs to which the respective ends of the tubular materials for the struts are fitted. The connectors are suitably hollow so that the individual stub pipes to which the ends of the tubular struts are fitted are hollow and inter-connected with each other through the connector. The stub pipes for the goal posts, crossbars and central bracing structure are all suitably of 3 inch (7.62 cm.) diameter whilst the corner bracing elements 10 and 11 are suitably of 2 inch (5.08 cm.) diameter.

An adequate structure may be put together simply by making the natural diameter of each tubular strut slightly less than the corresponding external diameter of the connector at the node and then force fitting the tubular material over the connector. Preferably, wire or suitable clips, for example Jubilee clips, may be used to hold the structure together. Alternatively, each tubular strut may have an integrally moulded hard plastics end formed with an internal screw thread, which is adapted to inter-fit with an external screw thread formed on the corresponding connector. In another alternative arrangement, the struts are permanently coupled together at the nodes. In this case, the connectors are suitably formed of the same or a similar material to that of the struts and the ends of the struts are glued or melded to the stub pipes to produce an integral structure.

Figure 2:
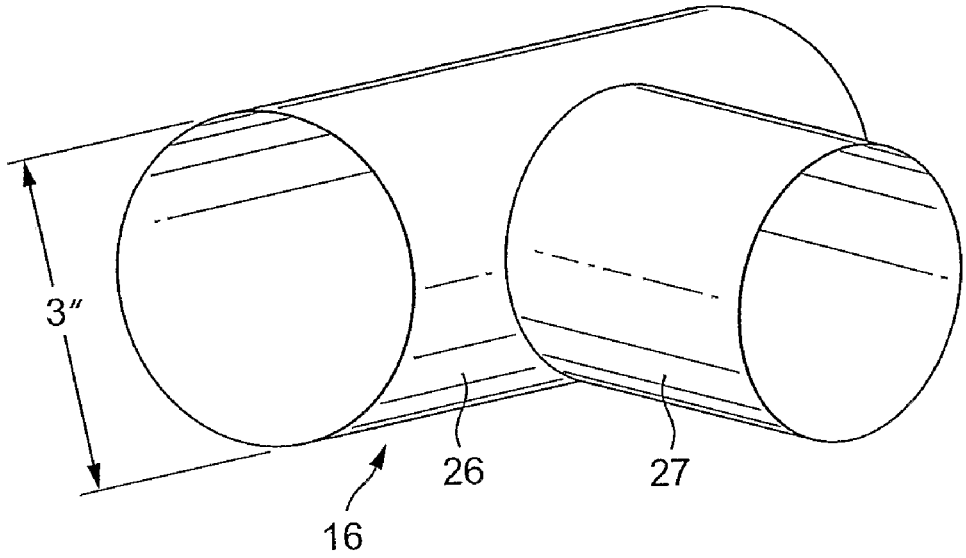
FIG. 2 is a somewhat schematic enlarged perspective view of a centre crossbar connector.

Referring again to the drawings, as shown in the schematic perspective view of FIG. 2, centre crossbar connector 16 comprises a short length of pipe 26 of 3 inch diameter with a short length of side pipe 27 at its central portion, also of 3 inch diameter.

Connectors 19 and 21 at the foot of the respective goal posts 2 and 3 consists of simple right angle bend pipe sections 28, 29 (FIG. 1).

Figure 3:
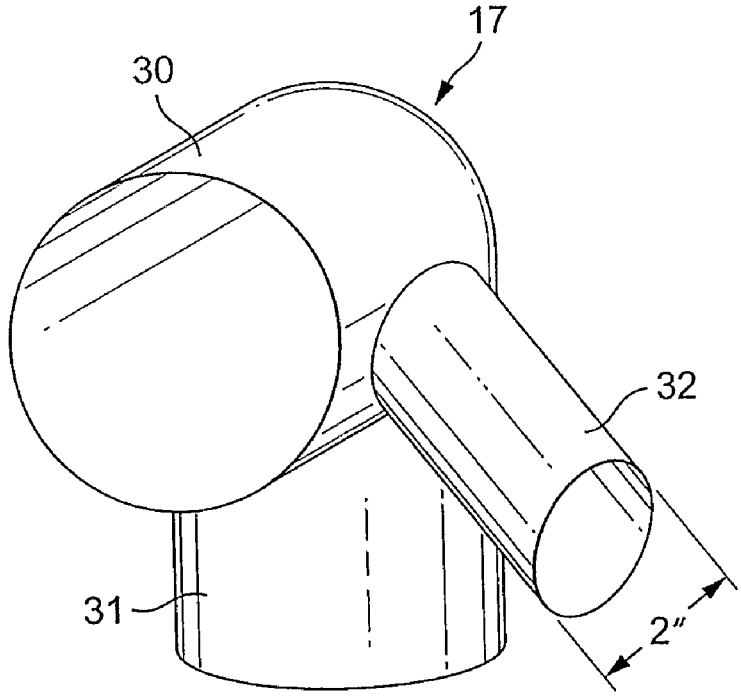
FIG. 3 is a similar view of a left top corner connector.
Figure 4:
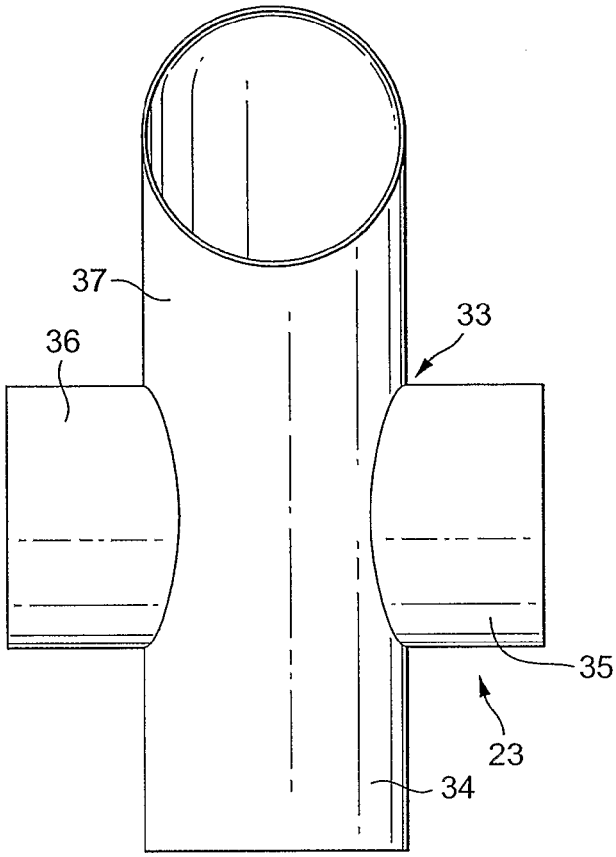
FIG. 4 is top plan view of a centre bottom connector.

FIG. 3 shows a schematic perspective view for top left corner connector 17 and comprises a right angle pipe section 30, 31, both sections being of 3 inch diameter, and a 2 inch diameter stub pipe 32 coupled thereto at an angle which will depend upon the length of the respective struts 6 and 10 forming the left side of the goal together with goal post 2. Connector 18 is the mirror image of connector 17. Connectors 20 and 22 at the rear comers are of similar configuration though the angle at which the 2 inch pipe section is connected to the right angle pipe section of 3 inch diameter will again depend on the respective dimensions of the struts 2, 6 and 10 or 3, 7 and 11 defining the respective side of the goal.

The central bracing structure comprises a triangular arrangement of struts 12, 13 and 14 inter-connected by connectors at nodes 23, 24 and 25. Strut 12 extends in a generally upright direction, though not necessarily vertically. Preferably it does extend vertically, but from a position forwardly of the rear of the goal defined by ground struts 8 and 9. As a result, the centre bottom connector 23 takes on a more complex construction, as best shown in the top plan view of FIG.

4. Connector 23 comprises a cruciform arrangement 33 forming stub pipes 34, 35, 36 and 37. The tubular material for struts 8 and 9 is respectively connected to stub pipes 35 and 36, while the tubular material for rear bracing ground strut 13 is coupled to stub pipe 34. Stub pipe 37 makes a right angle bend providing a generally upright section 38 to which upright bracing strut 12 is coupled.

Figure 5:
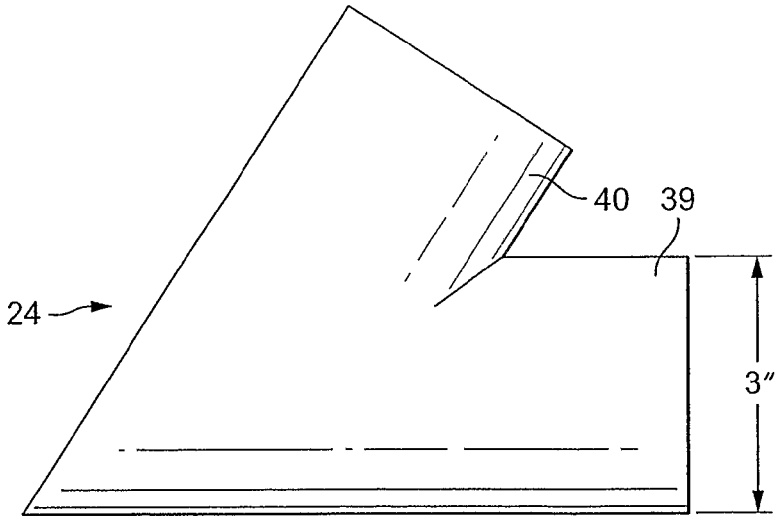
FIG. 5 is a side elevational view of a bottom rear centre bracing connector.

Bottom rear centre bracing node 24 takes a simple angled form as shown in the side elevational view of FIG. 5, the angle between respective stubs 39 and 40 for bottom ground bracing strut 13 and bracing strut 14 being determined by the length of those struts in relation to the upright 12.

Figure 6:
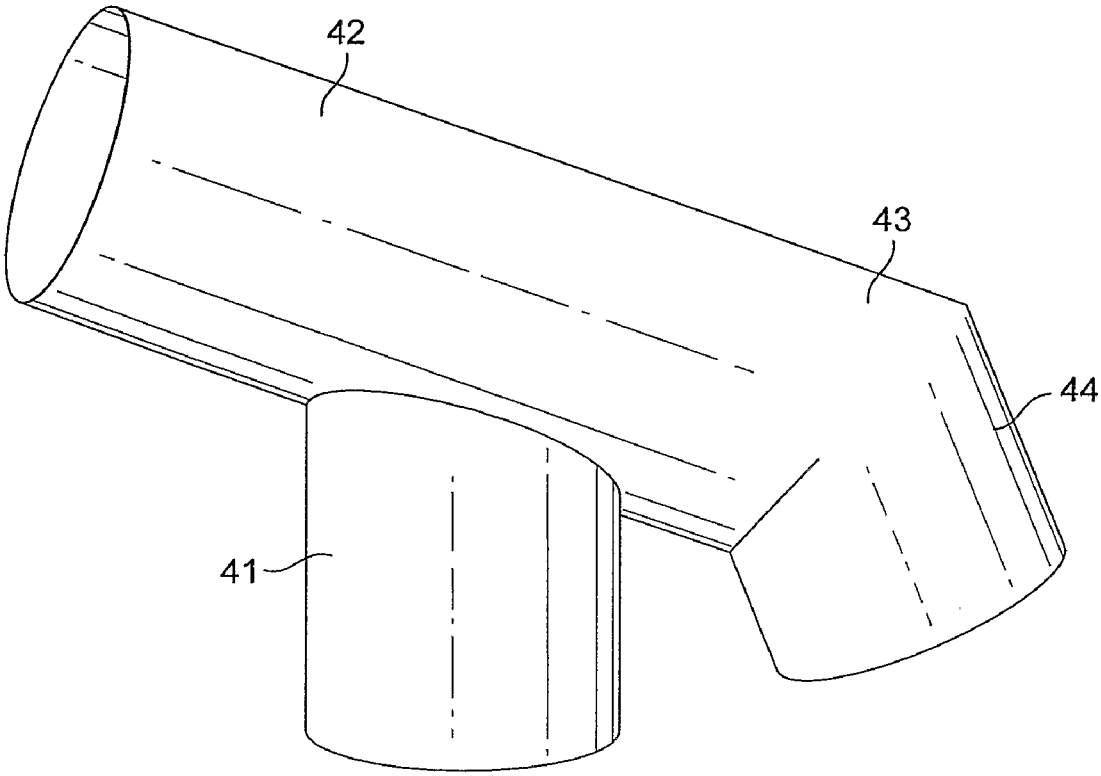
FIG. 6 is a somewhat schematic perspective view of a top centre bracing connector.

However, the connector 25 at the top of the centre bracing section has a more complex configuration, as shown in the generally schematic perspective view of FIG. 6. Upright bracing strut 12 is preferably slightly lesser in length than the height of the respective goal post struts 2 and 3 so that the angle formed between stub pipe 41 for strut 12 and stub pipe 42 for short centre bracing strut 15 is greater than 90°. This allows centre strut 15 in effect to buttress or bolster the centre section of the crossbar slightly from below, which assists in preventing it from sagging. Connected to the angled stub pipes 41, 42 is a further angled section 43, 44, section 43 being a continuation of stub pipe 42, and the precise angle between these sections being determined by the respective lengths of struts 12, 13 and 14 in the central bracing structure. As indicated in FIG. 6, all the stub pipes in this connector are preferably of 3 inch diameter.

Figure 7:
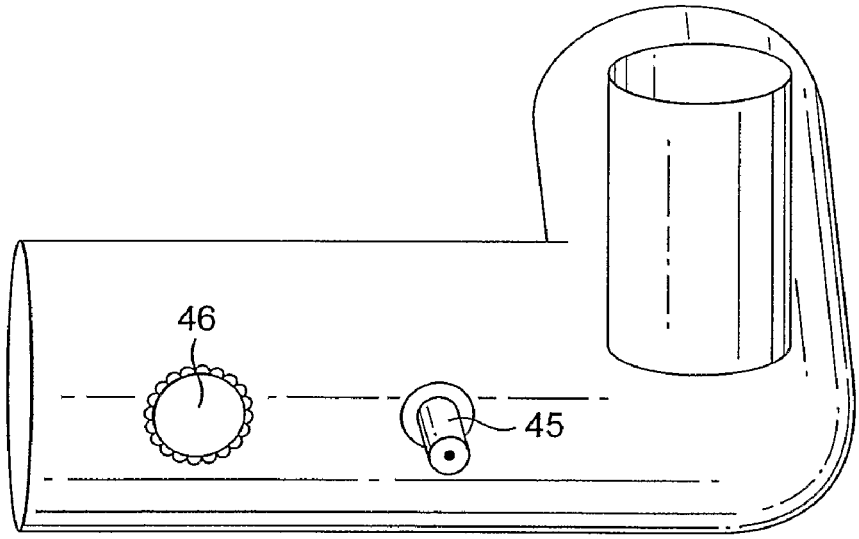
FIG. 7 shows the provision of valves on a rear corner connector.

The structure is provided with at least one and preferably more than one valve for a suitable pneumatic fluid, preferably air. As schematically indicated in FIG. 7 for left rear corner connector, rear corner connectors 20, 22 may be provided with respective inlet 45 and outlet 46 valves. The precise configuration of these valves is not of importance. Such valves are readily available in the marketplace, being used for pneumatic tyres, inflatable sun beds, "bouncy castles" and other children's play structures, etc. As will be readily understood, the valves could be placed elsewhere on the structure.

Figure 8:
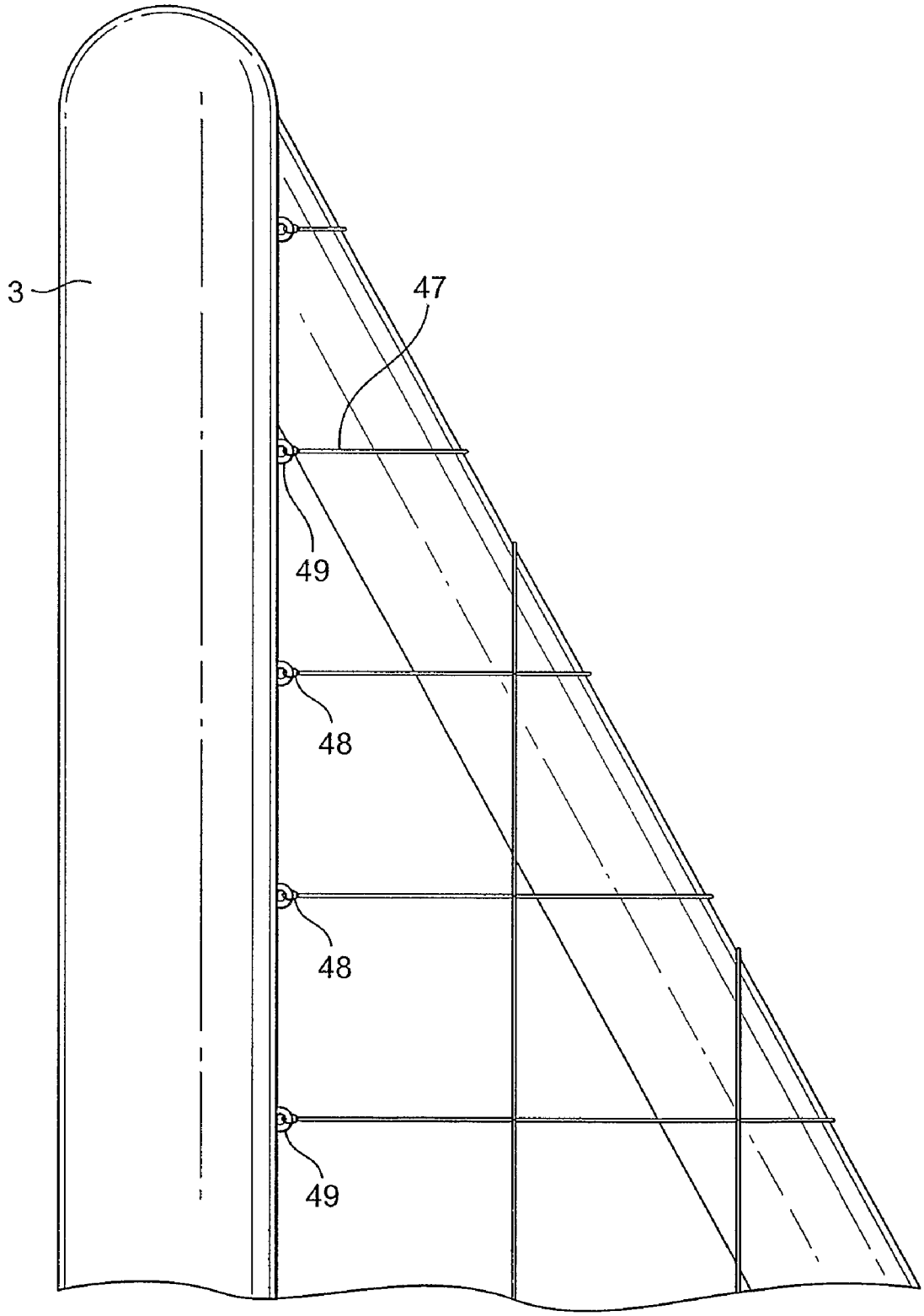
FIG. 8 shows a scrap view of the top corner of a goal, illustrating attachment of netting.

FIG. 8 is a scrap view of the top right corner of the goal as seen looking along the goal-line in the direction A indicated in FIG. 1, and shows how netting may be suitably attached to the structure formed by the inter-connected struts and connectors. As shown, netting 47 is simply tied or looped at positions 48 to hooks or eyes 49 integrally moulded in the material of the respective strut, here goal post strut 3.

The struts may be provided with additional hooks or eyes for guy ropes or anchors adapted to hold the goal in place in a high wind.

Figure 9:
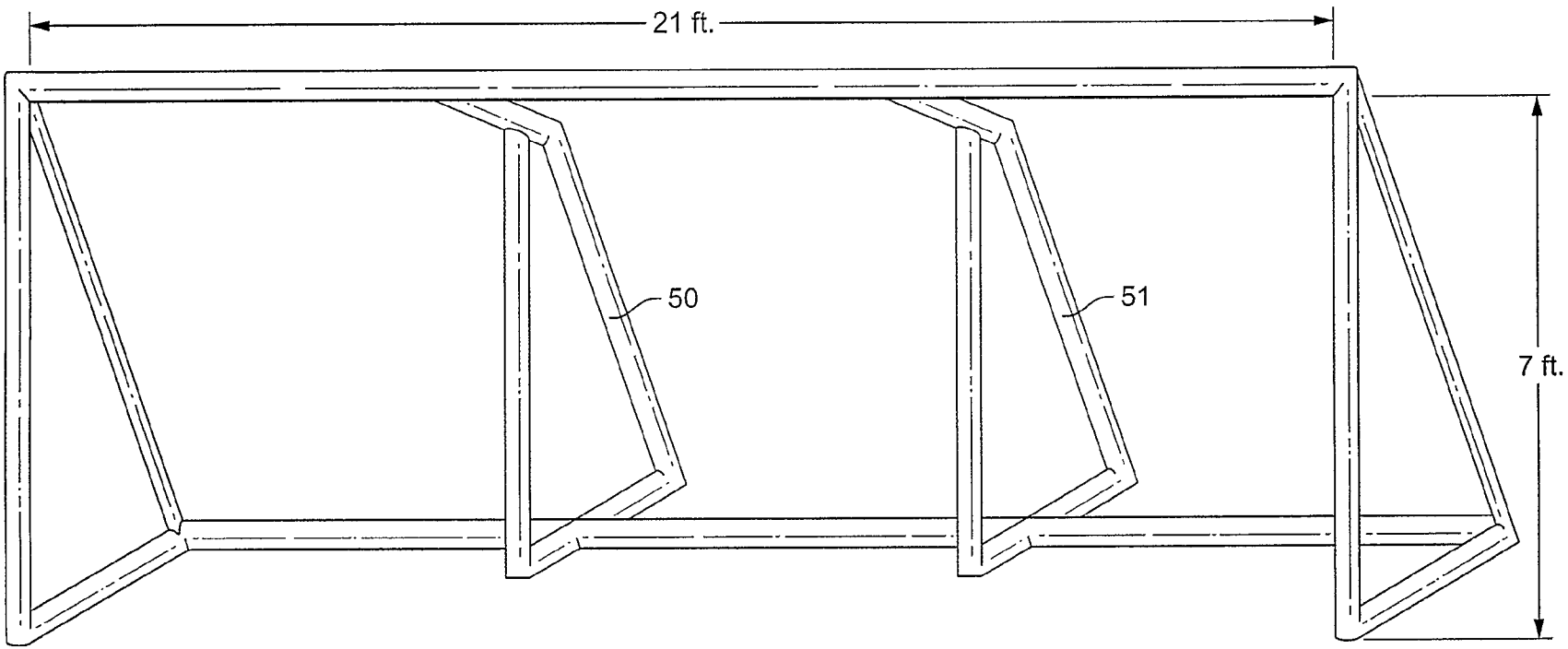
FIG. 9 is a view generally similar to FIG. 1 illustrating bracing for a larger goal.

In some circumstances the bracing provided by the central bracing structure shown in FIG. 1 may not prove sufficient. When additional bracing is found necessary in the central portion of the crossbar, additional bracing structures similar to that provided by struts 12, 13, 14 and 15 may be provided at a plurality of locations intermediate the lengths of the crossbar. FIG. 9 schematically illustrates a configuration suitable for a full size League, Cup or International goal with a crossbar of 21 ft. (6.4008 m.) and a goal post height of 7 ft. (2.1336 m.). Two intermediate bracing structures 50, 51, each of which may be similar to that illustrated in FIG. 1, are employed in this case.

Figure 10:
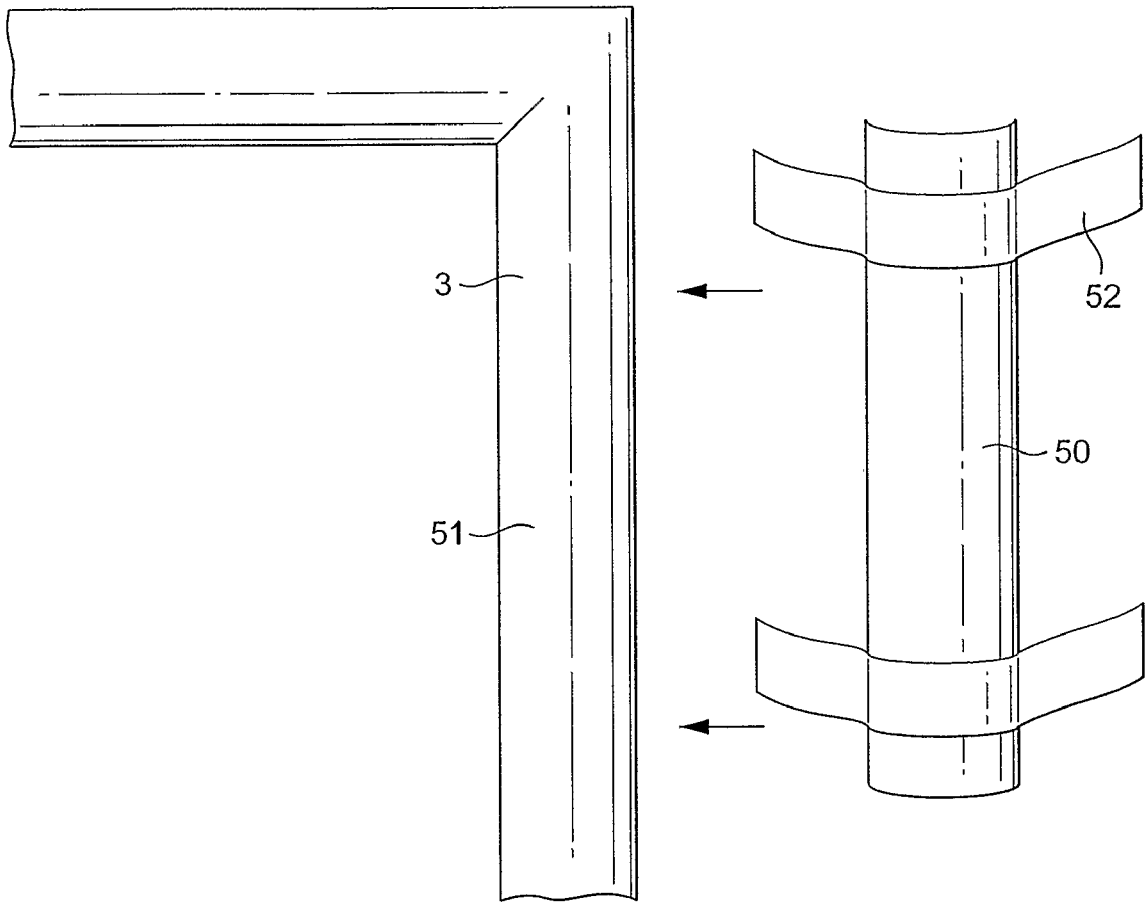
FIG. 10 shows the application of strengthening to a goal-post.

The major advantage of the sports goal structure described hereinabove is that it is readily demountable, can be packed away into a minimum of space and carried by car to a venue at which a sports fixture is to be played where it can readily be erected using a motor tyre pressure inflator as the source of pneumatic pressure. The upright struts 2 and 3 forming the goal posts provide a more forgiving contact with players' bodies should they strike the upright, as compared with a standard goal post. However where more rigidity is required, for example to ensure that should a ball strike the goal post it will be deflected in much the same way as it would be with standard goal post, the goal post may be strengthened by the application of a part tubular plastics shell as schematically illustrated in FIG. 10, in which an elongate length of relatively hard curved plastics shell 52 is applied to the front side of the goal post 3 and attached thereto by straps 53, suitably of VELCRO® hook-and-loop fastener.

Finally, although the invention has been described hereinabove with particular reference to Soccer (Association Football), practical embodiments of sports goals of suitably adapted sizes and structure may be produced in a similar fashion for playing other sports such as, but not restricted to, Hockey, Ice Hockey, Rugby Football, Gaelic Football, American Football and Australian Rules.

The invention claimed is:

1. A sports goal, comprising:

a structure comprising a plurality of struts interconnected to hollow connectors defining nodes between the struts comprising:

one or more struts defining a crossbar;

two or more struts defining respective goal posts;

a plurality of ground struts adapted to lie along the ground to define the bottoms of respective left and right sides and a rear of the goal;

bracing struts interconnecting ground struts with the nodes at which crossbar struts and goal post struts are connected to form a corner of the goal; and struts defining at least one generally triangular bracing structure interconnected with ground struts defining the rear of the goal and cantilevered to the crossbar at a point intermediate the length of the crossbar;

the struts being formed of a tubular material adapted to be pneumatically filled from a pneumatic pump, said at least one generally triangular bracing structure serving, when all of the struts are pneumatically filled, to support the crossbar intermediate its ends to resist sagging thereof;

each connector being formed with short lengths of stub pipe, the ends of lengths of tubular material defining respective struts being coupled to respective stub pipes; and one or more valves provided in the structure to enable the struts to be so filled from said pump.

2. A sports goal according to claim 1, further comprising netting attached to said structure.

3. A sports goal according to claim 2, wherein the netting is attachable to the struts via hooks or eyes integrally moulded with the tubular material.

4. A sports goal according to claim 1, wherein the tubular material is formed of natural or synthetic rubber, or of plastics substitutes therefor.

5. A sports goal according to claim 4, wherein the tubular material is reinforced with nylon thread.

6. A sports goal according to claim 1, wherein the struts are permanently connected to each other at the nodes.

7. A sports goal according to claim 1, wherein each node is defined by an individual hollow connector formed with short lengths of substantially rigid stub pipe and moulded as a single piece, and wherein the ends of lengths of tubular material defining respective struts are forced over the ends of respective stub pipes and coupled thereto.

8. A sports goal according to claim 1, wherein each node is defined by an individual hollow connector formed with short lengths of stub pipe connected at appropriate angles and formed as a single piece of a material adapted to be pneumatically filled, and wherein the ends of lengths of tubular material defining respective struts are coupled to respective stub pipes so that the sports goal as a whole may be deflated when not in use, transported to site and erected as a whole by pneumatic filling.

9. A sports goal according to claim 1, further comprising eyes or hooks provided on the structure and cooperating with guy lines and/or anchors to prevent the goal moving in high winds.

10. A sports goal according to claim 1, further comprising, for one or more of the struts adapted to form goal posts and/or the crossbar, an elongate curved plastics shell shaped to conform generally to the outer surface of the said strut when pneumatically filled, and adapted to be fastened thereabout by one or more hook-and-loop fastener strips.

11. A sports goal according to claim 1, provided as a kit of parts readily storable in the boot (trunk) of a car (automobile) for transport to the recreation ground at which a game is to be played for assembly on site into a demountable sports goal.

12. A kit of parts for assembly into an inflatable but demountable sports goal, the kit comprising a plurality of lengths of tubular material adapted to form struts and a plurality of hollow connectors, each formed of stub pipe, adapted to form nodes interconnecting struts to form a unitary structure comprising a crossbar, goal posts, ground struts defining the bottoms of respective left and right sides and a rear of a goal, bracing structures interconnecting the ground struts with corners of the goal defined between goalposts and ends of the crossbar, and at least one intermediate bracing structure comprising a generally triangular structure interconnected with ground struts defining the rear of the goal and cantilevered to the crossbar at a point intermediate the length of the crossbar, and serving to support the crossbar intermediate its ends in the inflated goal to resist sagging thereof, the tubular material being capable of being pneumatically filled from a source of pneumatic pressure through on or more valves provided in the tubular material or in the connectors.

13. A kit of parts according to claim 12, further comprising netting attachable to the assembly formed from said tubular material and connectors.

* * * * *

UNITED STATES PATENT AND TRADEMARK OFFICE

CERTIFICATE OF CORRECTION

PATENT NO. : 7,611,148 B2
APPLICATION NO. : 11/813911
DATED : November 3, 2009
INVENTOR(S) : T. Caswell It is certified that error appears in the above-identified patent and that said Letters Patent is hereby corrected as shown below:

| COLUMN | LINE | |
|---|---|---|
| 8 (Claim 12, line 17) | 15 | "on" should read --one-- |

Signed and Sealed this

Twenty-third Day of February, 2010

David J. Kappos

David J. Kappos
*Director of the United States Patent and Trademark Office*